US007465243B2

(12) United States Patent
Cramer

(10) Patent No.: US 7,465,243 B2
(45) Date of Patent: Dec. 16, 2008

(54) BALL HOLDING APPARATUS

(76) Inventor: Bryson Mimms Cramer, 9449 Pursuit Ct., Columbia, MD (US) 21045

( * ) Notice: Subject to any disclaimer, the term of this patent is extended or adjusted under 35 U.S.C. 154(b) by 0 days.

(21) Appl. No.: 11/586,786

(22) Filed: Oct. 26, 2006

(65) Prior Publication Data

US 2008/0102990 A1 May 1, 2008

(51) Int. Cl.
*A63B 69/00* (2006.01)

(52) U.S. Cl. ..... 473/417; 473/422; 473/434; 473/450

(58) Field of Classification Search ..... 473/422, 473/417, 428, 436, 451, 453; 273/348, 407
See application file for complete search history.

(56) References Cited

U.S. PATENT DOCUMENTS 4,227,691 A 10/1980 Lefebvre et al.
4,438,727 A * 3/1984 Thompson ..... 119/708
4,709,924 A 12/1987 Wilson et al.
4,819,937 A 4/1989 Gordon
4,989,866 A 2/1991 Dill
5,029,852 A * 7/1991 Gilfillan ..... 473/417
5,087,039 A 2/1992 Laseke
5,106,085 A 4/1992 Lewy
5,273,277 A 12/1993 Freese
5,322,276 A * 6/1994 Hardison, Jr. ..... 473/417
5,467,979 A * 11/1995 Zarate ..... 473/429
5,556,091 A 9/1996 Lin
5,595,384 A * 1/1997 Hardison, Jr. ..... 473/453
5,642,880 A 7/1997 Wiseman et al.
5,928,092 A * 7/1999 Keeter et al. ..... 473/417
6,238,307 B1 5/2001 Owen
6,575,119 B1 * 6/2003 Lonsway ..... 119/708
6,666,781 B1 * 12/2003 Illis ..... 473/453

* cited by examiner

*Primary Examiner*—Mitra Aryanpour

(57) ABSTRACT

An apparatus for practicing baseball and softball hitting skills includes a ball holder on a rod that is suspended by a single degree of freedom support at an interior point of the rod length and the rod is balanced and proportioned relative to the support point and the ball in order to position a ball at any three-dimensional location in the hitting zone of the batter in a stable state by manual movement of the opposite balanced end of the rod.

12 Claims, 2 Drawing Sheets

BALL HOLDING APPARATUS

BACKGROUND OF THE INVENTION

1. Field of Invention

The present invention relates to an apparatus to aid practice hitting of a baseball or softball supported by a ball holder that can be moved to position the ball to be hit almost instantly at any position in the hitting zone, in or out of the strike zone. The present invention relates generally to athletic equipment and more particularly to an apparatus for holding balls for batting practice.

2. Description of the Prior Art

The most common method of repetitive practice of the art of hitting a softball or baseball, particularly for young or inexperienced players, is hitting the ball off of a batting T into a net or field. There are a significant number of relevant patented devices. Those patents are: U.S. Pat. No. 4,227,691, Lefebvre, et. al.; U.S. Pat. No. 6,238,307, Owen; U.S. Pat. No. 4,709,924, Wilson et al.; U.S. Pat. No. 5,556,091, Lin; U.S. Pat. No. 4,989,866, Dill; U.S. Pat. No. 4,819,937, Gordon; U.S. Pat. No. 5,928,092, Keeter et al.; U.S. Pat. No. 5,106,085, Lewy; U.S. Pat. No. 5,642,880, Wiseman et al.; U.S. Pat. No. 5,273,277, Freese; U.S. Pat. No. 5,087,039, Laseke, all of which are incorporated herein by reference.

The device of Lefebvre, Owen, Wilson, Lin, Dill, Gordon and Keeter are all variations of the basic batting T with a telescoping vertical tube for height adjustment with different methods of adjusting the ball location to inside and outside locations relative to the batter. All are also capable of locating the held ball out front or later relative to the flight of a pitched ball. Devices similar to these are currently or have been commercially available. Significant detail on the importance of hitting the ball at the optimum contact angle is provide by Owen. The optimum angle is related primarily to making bat contact with an inside pitch when the ball is over, or in front of, the front part of the plate, a so-called early swing, or making bat contact with an outside pitch when the ball is over, or behind, the rear part of the plate, a so-called late swing. The device of Keeter includes features to encourage a level swing. All require the loosening or tightening of mechanical parts of the device to reposition the ball.

The device of Lewy is multifaceted with the primary intent of being able to teach hitting a stationary ball at the correct contact angle by controlling the position of the batter's feet and relocating the position of the ball holder. The device of Wiseman relocates the batter's feet relative to a stationary ball holder via a marked mat.

The devices of Freese and Laseke have the primary intent of teaching a level or down angle swing. The device of Laseke is commercially available. It is noted that the device of Laseke includes a near horizontal rod with a ball holder and includes features for vertical adjustment of the ball location.

BRIEF SUMMARY OF THE INVENTION

The invention provides an apparatus including a ball holder supported by a horizontal rod, with the rod being supported to allow a trainer, or coach, to quickly position the holder so as to position a ball placed on the holder at any desired location within or outside of a designated strike zone marked by a home plate.

DETAILED DESCRIPTION OF THE INVENTION

Figure 1:
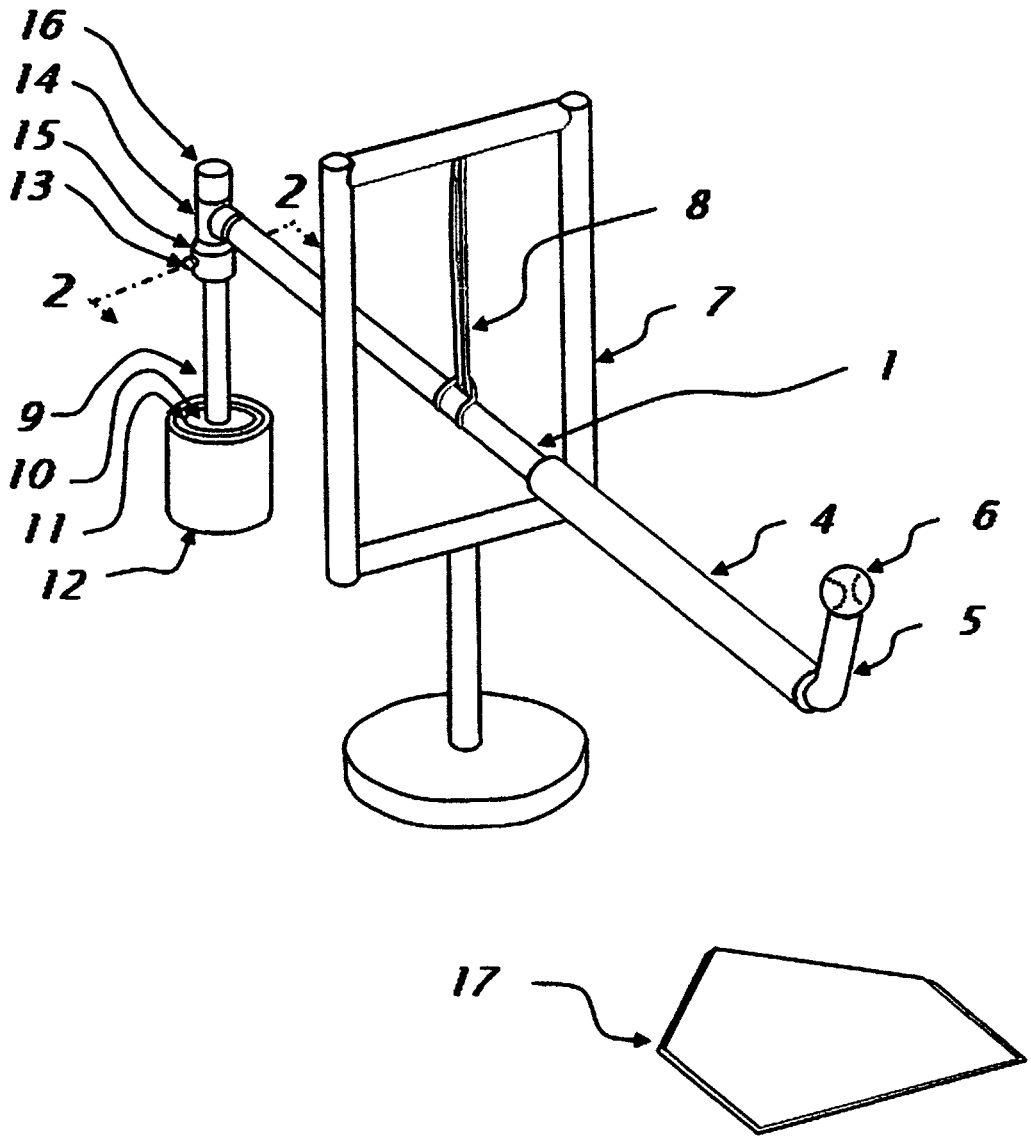
FIG. 1 is a perspective view of a preferred embodiment of an apparatus according to the invention.
Figure 2:
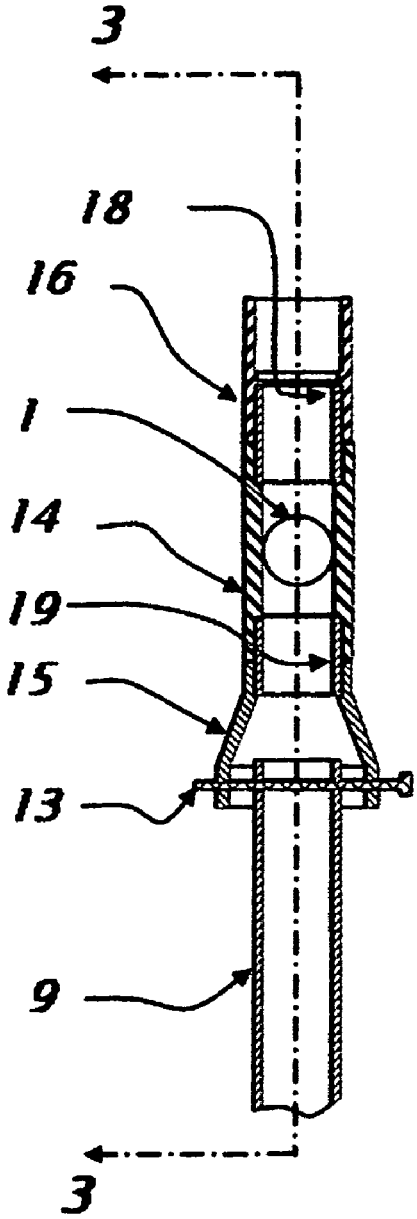
FIG. 2 is a first crosssectional view of one part of the apparatus according to the invention.
Figure 3:
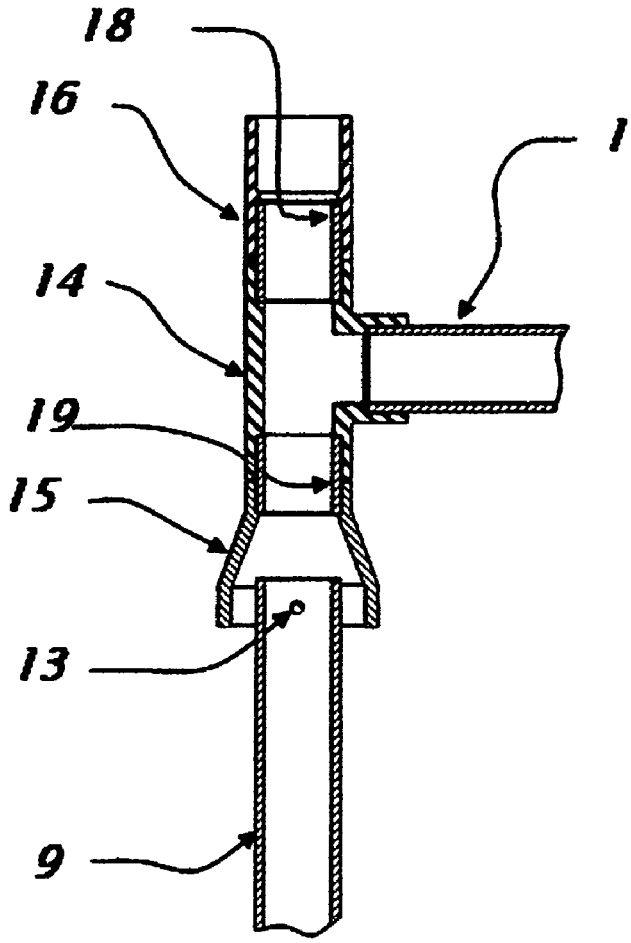
FIG. 3 is a crosssectional view, in a plane perpendicular to that of FIG. 2 of the part shown in FIG. 2.

Referring to FIGS. 1-3, the illustrated preferred embodiment of the invention includes a relatively rigid rod 1 that may be constructed of any suitable material and that may be partially covered with protective padding 4, for example a sheath of foam rubber, suitable to reduce damage to the bat or the rod by a bad swing. A ball holder 5 is mounted to the forward end of rod 1 and may be of any suitable material that can withstand repeated impacts from the bat without damaging the bat. The upper end of holder 5 is shaped, as by having a concave form, to stably support a ball 6, as shown. In this respect, the upper end of holder 5 may be configured like the top of a conventional batting T. The geometry and orientation of the ball holder are such that the ball is held above the rod to allow bat contact with the ball without hitting the rod. A nominal distance of the top of holder 5 above rod 1 could be of the order of 8 inches, which would allow for a nominal level or slight uppercut swing at all ball locations in the strike zone. Ball holder 5 may also be covered with protective padding.

Many materials could be suitable for rod 1 and holder 5. These can include common 1½ inch diameter PVC pipe, which could be covered with common pipe insulation, or a specific automotive radiator hose which has the nominal geometry and can be press fitted onto the PVC pipe. However, holder 5 can have a diameter different from rod 1. A practical length for rod 1 is 92 inches.

A stand 7 is used to support rod 1 via a strap 8. Stand 7 can be of any suitable stable construction and strap 8 may be any suitable flexible material. For example, stand 7 can be a commercially available strike zone stand used for pitching practice. Strap 8 could be a loop of nylon rope or rubber 16 inches long, preferably adapted to support rod 1 at the center of the strike zone defined by stand 7. Strap 8 could be connected to rod 1 by a choker loop. A practical connection of strap 8 to stand 7 is a rapid link or tie wrap (not shown). Any other suitable form of connections may be used. Use of a choker loop facilitates set up adjustment by allowing the point at which rod 1 is supported to be easily adjusted to achieve the desired balance.

A counterbalance weight assembly 9, 10, 11, 12 is mounted at the rear end of rod 1 to approximately balance the ball holder and ball at the front end of the rod. The weight assembly is suspended from a balance end coupling assembly 14, 15, 16, mounted at the balance end of rod 1. The counterbalance weight assembly includes a connecting rod 9 that is connected to a coupling 15 of coupling assembly 14, 15, 16 by a pin 13 that extends through aligned holes in coupling 15 and rod 9. Pin 13 is oriented to provide a pivot axis that is perpendicular to the longitudinal axis of rod 1. The use of a pin joint is not required, but improves ease of use. The use of a pin also allows the rod and weight to be separated for ease of handling and transport. The geometry and orientation of weight assembly 9, 10, 11, 12 are such that its moment of inertia about the axis of the rod 1 is greater than the moment of inertia of ball 6 and ball holder 5, thus stabilizing rotation of the rod about its longitudinal axis and assuring that holder 5 retains a generally vertical orientation.

The components of weight assembly 9, 10, 11, 12 may be made of any suitable materials and size that result in approximate balance and required moment of inertia. In the illustrated embodiment, components 10, 11, 12 may be concentric weights of progressively increasing diameters force fitted together or joined together by any suitable adhesive or mechanical means. Those components may also be replaced by a unitary weight. Use of a choker loop with strap 8 in conjunction with weight assembly 9-12 prevents rotation of rod 1 about its longitudinal axis. A practical balance point for a 92 inch rod 1 is 52 inches from ball holder 3. One practical exemplary weight assembly consists of a 12 inch length of 1½ inch PVC pipe 9 glued into a 1½×3 inch bushing 10, a 3×4 inch bushing 11 and a 4×4 inch coupling 12.

Balance end coupling-handle assembly 14, 15, 16 is mounted to the rear end of rod 1. Detail sections of the coupling-handle assembly are shown in FIGS. 2 and 3. There are 2 specific purposes for the coupling handle assembly. One is to provide a handle 16 for ease of manipulation of the device. The second, discussed above, is to provide a coupling location for the connecting rod 9 and pin 13 such that the rod 1 and the balance weight assembly may be separated for transport and storage. The coupling-handle assembly in this depiction consists of a 1½ inch PVC "T" 12 with a 2 to 1½ inch coupling 15 on the bottom and a 1½ inch coupling 16 on the top. The assembly includes 1½ pipe sections 18 and 19. The assembly is bonded or mechanically attached in any suitable manner to the end of rod 1. The 2 inch diameter portion of the 2 to 1½ coupling is match drilled with the connecting rod 9 of the balance weight to accept pin 13. The top 1½ inch coupling 16 provides a handle for moving rod 1.

The orientation of the axis of pin 13 to the balance weight connecting rod 9 and rod 1 is detailed in FIGS. 2 and 3. The pin axis orientation by design transmits both a rod 1 roll axis stabilization torque and the rod 1 at strap 8 up and down pivot vertical balance. The pin axis orientation is normal to the up and down plane therefore the design releases the balance weight to hang plumb during up and down movements of rod 1. The overall design intent is to minimize the manual input forces required at handle 16 to move the ball 6 to a desired location. The design presented for this invention meets the overall intent.

It is recognized that numerous configurations and methods could be used to support and balance the rod effectively and easily with the desired results.

Description of Use.

In normal usage, a home plate 17 is set in a nominal location in front of the strike zone stand and under the ball holder. Home plate 17 is used for a reference for the batter to orient himself or herself as he or she normally would in typical play.

Ball 6 is placed on holder 5 and is positioned to simulate a pitch of a particular height by manual movement of balance end handle 16 up and down. The ball is positioned inside or outside relative to the batter by movement of balance end handle 16 from side to side. Both of these movements of the handle 16 result in movements of holder 5 in the respective opposite direction. The movements of holder 5 can be made to be larger or smaller than the corresponding movements of handle 16 by appropriate design of the balance point of connection of strap 8 along the length of rod 1. A practical amplification factor is 1.5.

Ball 6 can be positioned in front of, over, or behind home plate 17 by acting on handle 16 to move rod 1 along its longitudinal axis. The practical range of the device shown between a point approximately 8 inches in front and 8 inches behind home plate 15, which is sufficient for positioning the ball at optimum contact angles. The practical range of movement in the vertical direction and the practical range of movement from inside to outside are greater than the boundaries of the typical strike zone. It is noted that the range of all current devices is limited to less than the typical strike zone.

In summary, the different locations at which the ball can be positioned include, relative to the batter and in common baseball terms, inside and outside, low and high, in front of and behind a home plate in terms of the flight of a ball from a pitcher in front of the batter before the pitch passes to the catcher or later in the flight of the ball.

It will thus be seen that the device according to the invention allows ball positioning movements with three translational degrees of freedom: up and down, left and right, in front of or behind a home plate.

A device according to the invention has the advantage that a ball for practice hitting may be repositioned easily at any location within the strike zone, and with the optimum hitting angle after the batter has assumed his or her normal batting stance and orientation to home plate. In practical usage, a second ball to be hit from a different location can be set up within a few seconds after the batter completes a practice hit and while still in his or her normal orientation to home plate.

Another feature of the invention is that the device is capable of positioning balls for practice hitting outside of the normal strike zone.

The current state of the art does not provide either of these features.

The ease and speed of changing ball locations with this device makes it possible for the batter to effectively practice hitting balls at any location in the strike zone at the optimum hitting angle and also hitting balls within reach outside of the normal strike zone.

The device is a significant improvement to the commonly used stationary batting "T", which must be adjusted manually to vary the position of the ball; but their adjustment is awkward and the batter practicing will typically adjust his stance and location also, reducing the benefit of adjusting the ball location at all.

In practical use, 2 players and a coach use the device. One player bats the balls into a net, screen or open field. The second player places the next ball and the coach adjusts the ball location.

A typical sequence of skill repetition is:

1) 5 balls hit with the ball located in the middle of the strike zone at a distance where the batter adjusts the location of his feet to hit the ball solidly.
2) 5 balls hit with the location progressively moved from the down the middle to low and outside. During that progression the ball location is also pulled back to near optimum contact angle to simulate hitting the ball later in terms of the flight of the ball, while the batter's feet remain in the same location.
3) 5 balls hit at the low and outside location
4) 5 balls hit in the middle of the strike zone
5) Change batter and repeat.

A repeat of the above with a sequence of 2 balls in the middle, one in each of the 4 corners, and one in the center of each edge of the strike zone and finishing with 2 in the center, is a typical follow up to the above.

It is commonly accepted that it is most difficult to hit low and outside pitches. It is commonly accepted that hitting a ball down the middle is easier than hitting the ball at the corners of the strike zone. Because the pitch location can be adjusted with ease using apparatus according to the invention, the batter can perform multiple repetitions hitting the ball in the easiest location with a proper swing and then progress to the more difficult locations while still in the same stance and using the same proper swing with minor adjustments.

During use of apparatus according to the present invention by the inventor, it has been observed that each player has a particular location in the strike zone to which their particular swing development is most suited. With this invention the coach can easily adjust the ball location to where the player hits the ball well and then build on that with gradual progressions to the more difficult locations so that the same good mechanics of that player's swing are repeated for all ball locations.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. An apparatus to aid practice hitting of a baseball or softball, said apparatus comprising:

an elongated rod having a front end, a rear end and a longitudinal axis that extends between said front and rear ends;

a support device for resting on a ground surface and including an element for suspending said rod at a point between said front and rear ends while allowing said rod to be displaced relative to said support device a ball holder mounted to said front end of said rod and adapted for supporting a ball to be hit freely from the holder; and a handle mounted to said rear end of said rod and used for manually manipulating said device;

wherein using said handle said rod is displaceable relative to said support device by at least one of or all of simultaneously: horizontal translation, horizontal pivoting, and vertical pivoting by manual action on said rear end of said rod to position a ball supported on said ball holder for hitting practice at different locations relative to a batter's hitting one.

2. The apparatus of claim 1, further comprising:

a balance member mounted to said rear end of said rod as a counterbalance to said ball holder.

3. The apparatus of claim 2 wherein said balance member is oriented relative to said rod to oppose rotation of said rod about the longitudinal axis.

4. An apparatus to aid practice hitting of a baseball or softball, said apparatus comprising:

an elongated rod having a front end, a rear end and a longitudinal axis that extends between said front and rear ends;

a support device for resting on a ground surface and including an element for suspending said rod at a point between said front and rear ends while allowing said rod to be displaced relative to said support device;

a ball holder mounted to said front end of said rod and adapted for supporting a ball to be hit freely from the holder; and a handle mounted to said rear end of said rod and used for manually manipulating said device;

wherein using said handle rod is displaceable relative to said support device by manual action on said rear end of said rod to position a ball supported on said ball holder for hitting practice at different locations relative to a batter's hitting zone, wherein said rod is supported by said support device at a selected location between said front and rear ends of said rod in order to allow pivoting of said rod in both vertical and horizontal planes relative to said support simultaneously by manual action on said rear end of said rod.

5. An apparatus to aid practice hitting of a baseball or softball, said apparatus comprising:

an elongated rod having a front end, a rear, end and a longitudinal axis that extends between said front and rear ends;

a support device for resting on a ground surface and including an element for suspending said rod at a point between said front and rear ends while allowing said rod to be displaced relative to said support device;

a ball holder mounted to said front end of said rod and adapted for supporting a ball to be hit freely from the holder; and a handle mounted to said rear end of said rod and used for manually manipulating said device;

wherein using said handle rod is displaceable relative to said support device by manual action on said rear end of said rod to position a ball supported on said ball holder for hitting practice at different locations relative to a batter's hitting zone, wherein said support device further allows translational movement of said rod along the longitudinal axis of said rod.

6. The apparatus of claim 1, wherein the different locations at which the ball can be positioned include, relative to the batter and in common baseball terms, inside and outside, low and high, in front of and behind a home plate in terms of the flight of a ball from a pitcher in front of the batter before the pitch passes to the catcher or later in the flight of the ball.

7. The apparatus of claim 6 wherein the manual action on said rear end of said rod enables the ball to be manually positioned for hitting practice at any combination of the different locations.

8. The apparatus of claim 1, wherein said support device encloses an area and said rod extends through said area.

9. The apparatus of claim 1, wherein said rod is manually displaceable relative to said support device by pivotal movements relative to said element.

10. An apparatus to aid practice hitting of a baseball or softball, said apparatus comprising:

an elongated rod having a front end, a rear end and a longitudinal axis that extends between said front and rear ends;

a support device for resting on a ground surface and including a flexible strap for suspending said rod at a point between said front and rear ends while allowing said rod to be displaced relative to said support device;

a ball holder mounted to said front end of said rod and adapted for supporting a ball to be hit freely from the holder;

a handle mounted to said rear end of said rod and used for manually manipulating said device; and a balance member mounted to said rear end of said rod as a counterbalance to said ball holder, said balance member being oriented relative to said rod to oppose rotation of said rod about the longitudinal axis;

wherein: said rod is supported by said support device at a selected location between said front and rear ends of said rod in order to allow pivoting of said rod relative to said support device in both vertical and horizontal planes; using said handle said rod is displaceable by manual action on said rear end of said rod to position a ball supported on said ball holder for hitting practice at different locations relative to a batter's hitting zone; said support device further allows translational movement of said rod along the longitudinal axis of said rod; the different locations at which the ball can be positioned include, relative to the batter and in common baseball terms, inside and outside, low and high, in front of and behind a home plate in terms of the flight of a ball from a pitcher in front of the batter before the pitch passes to the catcher or later in the flight of the ball; and the manual action on said rear end of said rod enables the ball to be manually positioned for hitting practice at any combination of the different locations.

11. The apparatus of claim 10, wherein said support device encloses an area and said rod extends through said area.

12. The apparatus of claim 10, wherein said rod is manually displaceable relative to said support device by pivotal movements relative to said strap.

* * * * *